US009267323B2

(12) United States Patent
Whooley

(10) Patent No.: US 9,267,323 B2
(45) Date of Patent: Feb. 23, 2016

(54) DECORATIVE GATE COVERING

(71) Applicant: Lora M. Whooley, Scottsdale, AZ (US)

(72) Inventor: Lora M. Whooley, Scottsdale, AZ (US)

( * ) Notice: Subject to any disclaimer, the term of this patent is extended or adjusted under 35 U.S.C. 154(b) by 140 days.

(21) Appl. No.: 14/134,038

(22) Filed: Dec. 19, 2013

(65) Prior Publication Data

US 2014/0170366 A1 Jun. 19, 2014

Related U.S. Application Data

(60) Provisional application No. 61/739,470, filed on Dec. 19, 2012.

(51) Int. Cl.
*E06B 9/00* (2006.01)
*E06B 9/02* (2006.01)

(52) U.S. Cl.
CPC ..... *E06B 9/02* (2013.01); *E06B 2009/002* (2013.01); *Y10T 428/24744* (2015.01)

(58) Field of Classification Search
CPC ..... Y10T 428/24744; E06B 2009/002
USPC ..... 428/81, 99, 83
See application file for complete search history.

(56) References Cited

U.S. PATENT DOCUMENTS

| | | | | |
|---|---|---|---|---|
| 4,852,194 | A | 8/1989 | Langan | |
| 5,351,733 | A | 10/1994 | Ullman | |
| 5,922,437 | A | 7/1999 | Bryant | |
| 7,178,792 | B2 | 2/2007 | Monahan et al. | |
| 2006/0115620 | A1* | 6/2006 | Anderson | 428/99 |
| 2009/0047535 | A1 | 2/2009 | Crilly | |
| 2009/0211761 | A1 | 8/2009 | Broussard | |
| 2010/0108210 | A1 | 5/2010 | Salas Garcia | |
| 2011/0296666 | A1 | 12/2011 | Silverman | |

* cited by examiner

*Primary Examiner* — Brent O'Hern
(74) *Attorney, Agent, or Firm* — Thomas W. Galvani, P.C.; Thomas W. Galvani

(57) ABSTRACT

A decorative covering for covering a passageway gate, the covering including a sleeve bounding a gate-receiving area. The sleeve has a front, a back, and a perimeter between the front and back. The gate-receiving area is sized and shaped to receive and cover a gate between the front, back, and perimeter of the sleeve. The perimeter includes a bottom which is releasably coupled to the front of the sleeve to move between a closed position secured to the front of the sleeve and an open position away from the front of the sleeve, defining an entrance to the gate-receiving area sized to receive the passageway gate for application therethrough. Openings are formed in the perimeter in communication with the gate-receiving area.

19 Claims, 10 Drawing Sheets

DECORATIVE GATE COVERING

CROSS-REFERENCE TO RELATED APPLICATIONS

This application claims the benefit of U.S. Provisional Application No. 61/739,470, filed Dec. 19, 2012, which is hereby incorporated by reference.

FIELD OF THE INVENTION

The present invention relates generally to passageway safety gates, and more particularly to devices for aesthetically incorporating safety gates into the style of a home.

BACKGROUND OF THE INVENTION

Passageway safety gates are used in doorways, hallways, stairways, and other like passageways inside and outside of homes that contain infants, children, and pets. Adults use safety gates to establish barricades to block off a portion of the home so as to prevent access by the infants, children, or pets. For instance, many safety gates are used at the top and bottom of stairs to prevent a child who is still learning to walk from falling down the stairs. Safety gates are used in passageways of different dimensions; while many passageways have a common size dictated by local building codes, some may still be wide and others narrow, depending on the use and nature of the passageway. Safety gates are available in a variety of arrangements for such different widths; some safety gates have a fixed width to be installed in a passageway of one of several standard dimensions. Other safety gates are adjustable in width and can be adjustably configured to fit in doorways, hallways, stairways, and other passageways of differing widths. Still other safety gates include hinged doors that allow the safety gate to be installed and still provide ingress and egress to adults. Yet still other gates are mounted in the passageway for temporary installation, while others are permanently mounted in the passageway, as by screwing or anchoring into the wall.

Most safety gates are constructed with a plurality of frame members, namely, horizontal top and bottom frame members and vertical frame members. The rails or frame members in such gates can be quite ugly. Other safety gates have a peripheral frame and a mesh panel stretched across the peripheral frame. While these gates may be more aesthetically pleasant than those with rails or frame members, they can still stand out in a house. Indeed, most safety gates are purely functional and lack any ornamental aspects. In most homes, this is aesthetically jarring. Such safety gates appear out of place and disjointed in homes in which interior design and decoration is important to the homeowner.

Various attempts have been made to provide ornamentation to safety gates. However, such attempts have chiefly targeted children as the audience for the ornamentation, with animal faces emblazoned on the safety gates, with twinkling lights, or with other child-oriented displays. These approaches turn the safety gate into an entertainment device, which can actually attract a child rather than blending in with the surrounding decor. Moreover, many of the decorations are permanently attached on the safety gate as part of the safety gate, or must be installed before the safety gate is installed in the passageway. An improved device for concealing or blending the safety gate into the interior design of a home is needed.

SUMMARY OF THE INVENTION

According to the principle of the invention, an embodiment of a decorative covering for covering a passageway gate includes a sleeve bounding a gate-receiving area. The covering may be applied to the gate when the gate is free of a passageway, or may be applied after the gate has already been fixed within a passageway, in which the horizontal top and bottom frame members are anchored to the passageway. The sleeve has a generally planar front, a generally planar back, and a perimeter edge between the front and back. The gate-receiving area has a thin, rectangular profile disposed between the front and back. A bottom of the perimeter edge is releasably coupled to the front of the sleeve to move between a closed position and an open position. In the closed position, the bottom is secured to the front of the sleeve, and in the open position, an entrance to the gate-receiving area is formed. When the bottom is in the open position, the covering can be applied over the passageway gate for application while the gate is installed in the passageway. Further, openings formed at corners of the sleeve are in communication with the gate-receiving area. The horizontal top and bottom frame members are closely received in the openings and extend through the openings to the wall of the passageway. In this way, the front, back, and perimeter edge of the sleeve conceal the gate, and the openings are small so that the gate is barely visible through them. Further, the front and back carry a decoration which blends into the aesthetic of the home.

BRIEF DESCRIPTION OF THE DRAWINGS

Referring to the drawings.

DETAILED DESCRIPTION

Figure 1:
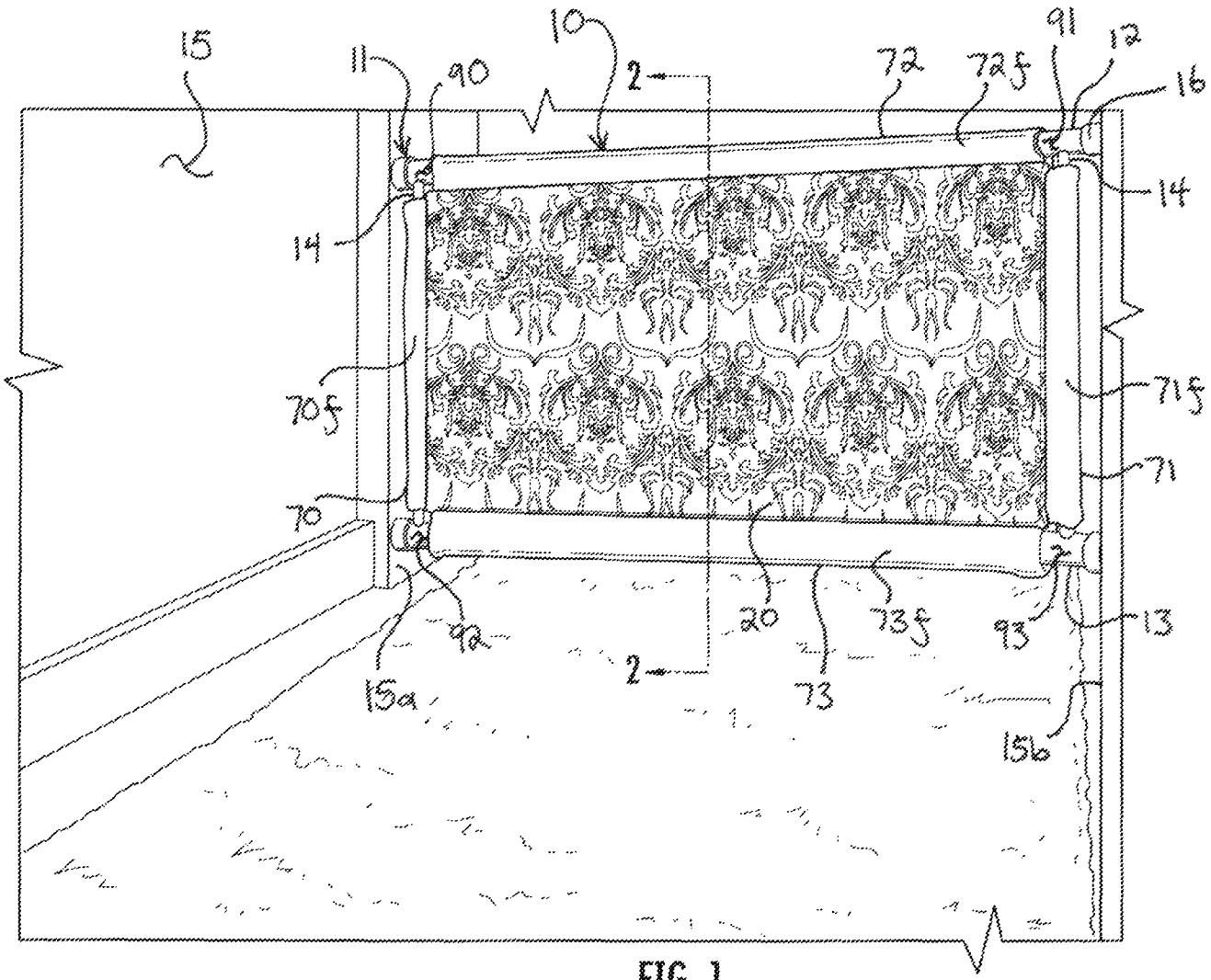
FIG. 1 is a front perspective view of a decorative gate covering constructed and arranged according to the principle of the invention, and installed on a passageway gate in a passageway.

Reference is now made to the drawings, in which the same reference characters are used throughout the different figures to designate the same elements. FIG. 1 illustrates a decorative gate covering 10, constructed and arranged according to the principle of the invention, in an assembled and applied condition on a passageway gate 11. The gate 11 is installed in a passageway 15 in a house. The gate 11 includes a top frame member 12, an opposed bottom frame member 13, and a plurality of vertical frame members 14 extending between the top and bottom frame members 12 and 13, of which two vertical frame members are exposed just slightly by the covering 10 at junctures with the top and bottom frame members 12 and 13. The gate 11 may be configured with expansion elements on the top and bottom frame members 12 and 13 to expand and contract the gate 11 so as to be adjustably fit and installed between opposed walls 15*a* and 15*b* in stairways, hallways, doorways, and like passageways. For reference purposes only, a front 16 of the gate 11 is shown in FIG. 1, with an opposed back 17 hidden from view behind the front 16. It should be understood that although the front 16 and back 17 are identified in this way throughout the description, the gate 11 may be oriented with either the front 16 or back 17 facing one direction or another.

The covering 10 includes opposed, substantially coextensive coverlets or panels 20 and 21 sized to cover the front 16 and back 17, respectively, of the gate 11. The panel 20 is shown in FIG. 1 covering the front 16 of the gate 11, and the panel 21 covering the back 17 is hidden from view by the panel 20, but is identical to the panel 20 and is shown in various other FIGS.

Figure 2:
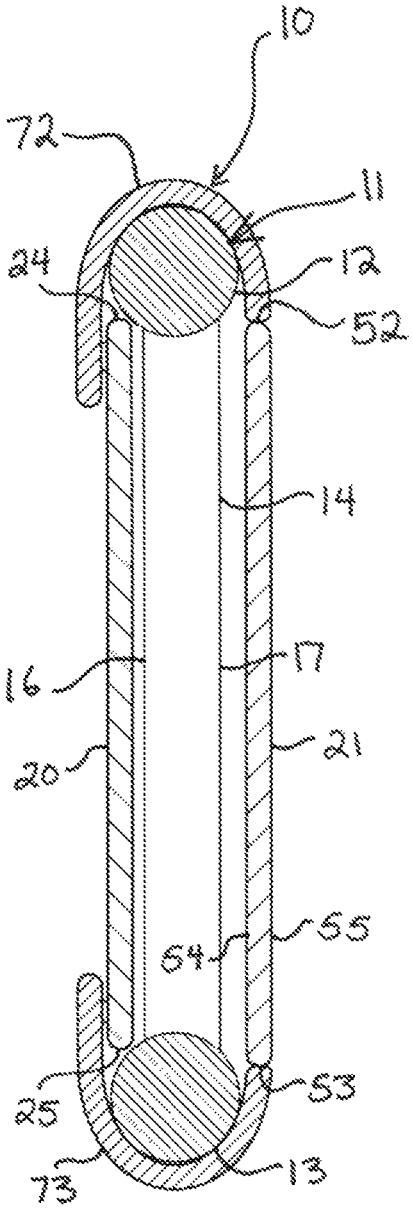
FIG. 2 is a section view taken along the line 2-2 in FIG. 1 of the decorative gate covering of FIG. 1 installed on the gate.

Reference is now briefly made to FIG. 2, which is a section view taken along the line 2-2 in FIG. 1. FIG. 2 clearly illustrates the panel 20 covering the front 16 of the gate 11 from proximate to the bottom of the top frame member 12 to the proximate to the top of the bottom frame member 13.

Figure 3A:
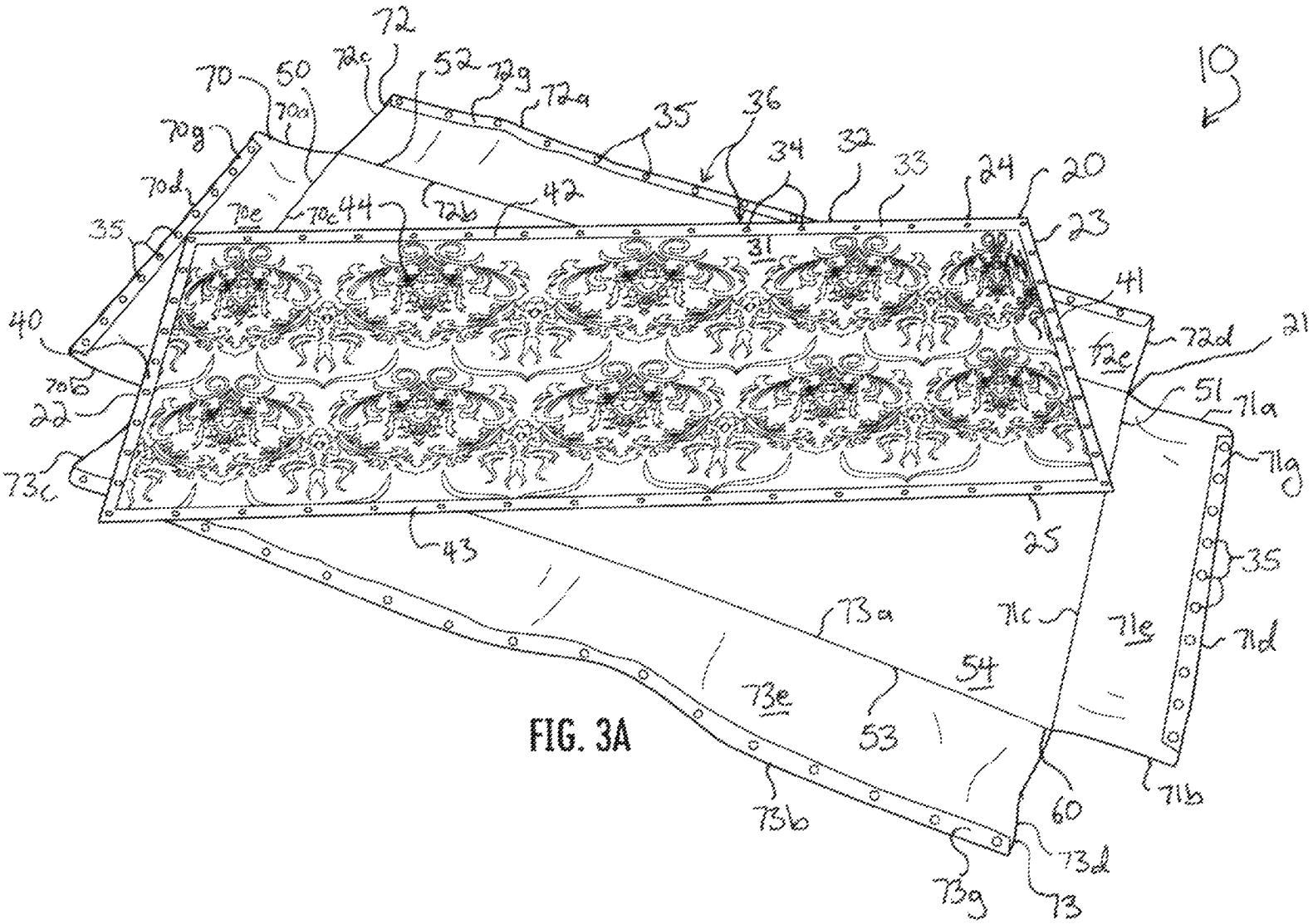
FIGS. 3A-3C are perspective views illustrating a sequence of steps of arranging and applying the decorative gate covering of FIG. 1 on the passageway gate.

With reference now to FIG. 3A, the covering 10 is shown free of the gate 11 with the panels 20 and 21 separated, and with the panel 20 on top of and diagonally offset from the panel 21. The panel 20 is a large, broad sheet of cloth, and includes opposed side edges 22 and 23, an upper edge 24 and opposed lower edge 25, and opposed inner and outer surfaces 30 and 31 (inner surface 30 shown in FIG. 2). The opposed side edges 22 and 23 are considered minor ends of the panel 20, and the opposed upper edge 24 and lower edge 25 are considered major ends of the panel 20, since the upper edge 24 and lower edge 25 are longer than the side edges 22 and 23. The side edges 22 and 23 are parallel with respect to each other and are each perpendicular to the upper edge 24 and lower edge 25. The upper edge 24 and lower edge 25 are parallel with respect to each other.

The panel 20 has a perimeter edge 32 which extends along the side edges 22 and 23, upper edge 24, and lower edge 25. A strip 33 carrying engagement elements 34 of an engagement assembly 35 is applied to the outer surface 31 of the panel 20 inboard of the perimeter edge 32. The strip 33 is secured on the outer surface 31 of the panel 20 as by stitching, adhesive, fabric welding, or like fastening method which provides a strong, durable, flexible, and permanent fastening to the outer surface 31. The engagement elements 34 are male snap fastener elements of the engagement assembly 35, and are sized and shaped to receive and snappedly engage with corresponding female snap fastener elements. One having ordinary skill in the art will appreciate that the engagement elements 34 may also be female snap fastener elements for snappedly engaging with corresponding male snap fastener elements, or that the engagement assembly 35 may be a different fastener such as a hook-and-loop fastener, slide fastener, or the like. The engagement elements 34 are aligned along the strip 33, are spaced apart, and are each directed outwardly away from the outer face 31 of the panel 20. The engagement elements 34 are secured to the strip 33 by stitching, adhesive, fabric welding, or like fastening method which provides a strong, durable, flexible, and lasting fastening to the flexible strip 33, thus the engagement elements 34 are secured to the panel 20 on the strip 33. The strip 33 is constructed from a flexible band of fabric, and is arranged along the perimeter edge 32 in segmented portions, including a side strip 40 applied along the side edge 22, an opposed side strip 41 applied along the side edge 23, an upper strip 42 applied along the upper edge 23, and an opposed lower strip 43 applied along the lower edge 25 of the panel 20. The opposed side strips 40 and 41 are parallel with respect to each other and are each perpendicular to the upper and lower strips 42 and 43. The upper and lower strips 42 and 43 are parallel with respect to each other.

The outer surface 31 of the panel 20 carries indicia or decoration 44. In the embodiment shown in FIG. 2, the decoration 44 on the outer surface 31 is a patterned design. In other embodiments, the decoration 44 may include a random design, textual elements, graphical elements, or other like indicia for observation, appreciation, or concealment of the covering 10. The inner surface 30 (not shown in FIG. 3A) is preferably blank and carries no decoration, though one having ordinary skill in the art will understand that the inner surface 30 could carry decoration even though the inner surface 30 is generally not visible when the covering 10 is in an installed condition on the gate 11.

With continued reference to FIG. 3A, the panel 21 is displayed underneath the panel 20. The panel 21 is nearly identical to the panel 20. The panel 21 is a large, broad panel of cloth, and includes opposed side edges 50 and 51, an upper edge 52 and opposed lower edge 53, and opposed inner and outer surfaces 54 and 55 (shown in FIG. 2). The opposed side edges 50 and 51 are considered minor ends of the panel 21, and the opposed upper edge 52 and lower edge 53 are considered major ends of the panel 21, as the upper and lower edges 52 and 53 are longer than the side edges 50 and 51. The side edges 50 and 51 are parallel with respect to each other and are each perpendicular to the upper edge 52 and lower edge 53. The upper and lower edges 52 and 53 are parallel with respect to each other.

Still referring to FIG. 3A, the panel 21 has a perimeter edge 60 extending along and including the side edges 50 and 51, the upper edge 52, and the lower edge 53. The outer surface 55 of the panel 21 carries decoration 62 that, although not shown in FIG. 3A, is preferably identical to the decoration 44 and thus need not be shown to be understood. The decoration 62 may include a random design, textual elements, graphical elements, or other like indicia for observation, appreciation, or concealment. The inner surface 54 of the panel 21 across the central panel 62 is blank and carries no decoration, though one having ordinary skill in the art will understand that the inner surface 54 could be applied with a decoration even though the inner surface 54 is generally concealed when the covering 10 is in an installed condition applied to the gate 11.

With continuing reference to FIG. 3A, four additional minor fabric panels are secured to the panel 21 at each of the ends of the panel 21 and define extensions or flaps of the panel 21. The flaps releasably couple the panel 21 to the panel 20 and form a perimeter around and between the panels 20 and 21. A first panel is affixed to the side edge 50 of the panel 21 and defines a side flap 70. The side flap 70 is tall and has a top 70*a*, an opposed bottom 70*b*, an inner side 70*c*, an opposed outer side 70*d*, an inner surface 70*e*, and an opposed outer surface 70*f* (shown in FIG. 1). The top 70*a* and bottom 70*b* are short, parallel with respect to each other, and perpendicular to each of the inner and outer sides 70*c* and 70*d*. The inner and outer sides 70*c* and 70*d* are parallel with respect to each other and are coextensive with respect to the side edge 50. The inner side 70*c* of the side flap 70 is affixed to the side edge 50 of the panel 21 with stitching, adhesive, fabric welding, or like fastening method which provides a strong, durable, flexible, and permanent fastening to the side edge 50. The inner surface 70*e* is coplanar to the inner surface 54, and the outer surface 70*f* is coplanar to the outer surface 55. Although shown as blank in FIG. 3A, the inner and outer surfaces 70*e* and 70*f* may carry indicia or decoration which can be the same as or different from decoration 44 or 62. Preferably, the decoration on the inner and outer surfaces 70*e* and 70*f* complements the decoration 44 or 62. A strip 70*g* carrying engagement elements 35 is applied to the inner surface 70*e* of the side flap 70 along the outer side 70*d* completely between the top 70*a* and bottom 70*b*. The strip 70*g* is secured on the inner surface 70*e* of the side flap 70 with stitching, adhesive, fabric welding, or like fastening method which provides a strong, durable, flexible, and permanent fastening to the inner surface 70*e*. The engagement elements 35 are female snap fastener elements of the snap closure engagement assembly 36, and are sized and shaped to receive and snappedly engage with the complemental male engagement elements 34. The engagement elements 35 are aligned along the strip 70G, are spaced apart from each other, and are each directed outwardly away from the inner surface 70E.

A second panel is affixed to the side edge 51 of the panel 21 and defines a side flap 71. The side flap 71 is tall and has a top 71*a*, an opposed bottom 71*b*, an inner side 71*c*, an opposed outer side 71*d*, an inner surface 71*e*, and an opposed outer surface 71*f* (shown in FIG. 1). The top 71*a* and bottom 71*b* are short, parallel with respect to each other, and perpendicular to each of the inner and outer sides 71*c* and 71*d*. The inner and outer sides 71*c* and 71*d* are parallel with respect to each other and are coextensive with respect to the side edge 51. The inner side 71*c* of the side flap 71 is affixed to the side edge 51 of the panel 21 with stitching, adhesive, fabric welding, or like fastening method which provides a strong, durable, flexible, and permanent fastening to the side edge 51. The inner surface 71*e* is coplanar to the inner surface 54, and the outer surface 71*f* is coplanar to the outer surface 55. Though illustrated as blank in FIG. 3A, the inner and outer surfaces 71*e* and 71*f* may carry indicia or decoration which can be the same as or different from decoration 44 or 62. Preferably, the indicia on the inner and outer surfaces 71*e* and 71*f* complements the decorations 44 or 62. A strip 71Gg carrying engagement elements 35 is applied to the inner surface 71*e* of the flap 71 and extends completely along the outer side 71*d* between the top 71*a* and bottom 71*b*. The strip 71*g* is secured on the inner surface 71*e* with stitching, adhesive, fabric welding, or like fastening method which provides a strong, durable, flexible, and permanent fastening to the inner surface 71*e*. The engagement elements 35 are aligned and spaced apart along the strip 71*g* and are each directed outwardly away from the inner surface 71*e*.

A third panel is affixed to the upper edge 52 of the panel 21 and defines an upper flap 72. The upper flap 72 is elongate and has a top 72*a*, an opposed bottom 72*b*, opposed sides 72*c* and 72*d*, an inner surface 72*e*, and an opposed outer surface 72*f* (shown in FIG. 1). The top 72*a* and bottom 72*b* are long, parallel with respect to each other, perpendicular to each of the sides 72*c* and 72*d*, and are coextensive with respect to the upper edge 52 of the panel 21. The sides 72*c* and 72*d* are short and are parallel with respect to each other. The side 72*c* is proximate to the side 50 of the panel 21, and the side 72*d* is proximate to the side 51 of the panel 21. The bottom 72*b* of the lower flap 72 is affixed to the upper edge 52 of the panel 21 with stitching, adhesive, fabric welding, or like fastening method which provides a strong, durable, flexible, and permanent fastening to the upper edge 52. The inner surface 72*e* is coplanar to the inner surface 54, and the outer surface 72*f* is coplanar to the outer surface 55. Shown as blank in FIG. 3A, the inner and outer surfaces 72*e* and 72*f* may carry indicia or decoration which can be the same as or different from decoration 44 or 62. Preferably, such decoration on the inner and outer surfaces 72*e* and 72*f* complements the decoration 44 or 62. A strip 72*g* carrying engagement elements 35 is applied to the inner surface 72*e* of the flap 72 along the top 72*a* between the sides 72*c* and 72*d*. The strip 72*g* is secured on the inner surface 72*e* as by stitching, adhesive, fabric welding, or like fastening method which provides a strong, durable, flexible, and lasting fastening to the inner surface 72*e*. The engagement elements 35 are aligned and spaced apart along the strip 72*g* and are each directed outwardly away from the inner surface 72*e*.

Finally, and with reference still to FIG. 3A, a fourth panel is affixed to the lower edge 53 of the panel 21 and defines a lower flap 73. The lower flap 73 is elongate and has a top 73*a*, an opposed bottom 73*b*, opposed sides 73*c* and 73*d*, an inner surface 73*e*, and an opposed outer surface 73*f* (shown in FIG. 3A). The top 73*a* and bottom 73*b* are long, parallel with respect to each other, perpendicular to each of the sides 73*c* and 73*d*, and are coextensive with respect to the lower edge 53 of the panel 21. The sides 73*c* and 73*d* are short and are parallel with respect to each other. The side 73*c* is proximate to the side edge 50 of the panel 21, and the side 73*d* is proximate to the side edge 51 of the panel 21. The top 73*a* of the flap 73 is affixed to the lower edge 53 of the panel 21 with stitching, adhesive, fabric welding, or like fastening method which provides a strong, durable, flexible, and permanent fastening to the lower edge 53. The inner surface 73*e* is coplanar to the inner surface 54, and the outer surface 73*f* is coplanar to the outer surface 55. Though shown without any decoration in the various FIGS., the inner and outer surfaces 73*e* and 73*f* may carry indicia or decoration which can be the same as or different from decoration 44 or 62. Preferably, the indicia on the inner and outer surfaces 73*e* and 73*f* complements the decoration 44 or 62. A strip 73*g* carrying engagement elements 35 is applied to the inner surface 73*e* of the flap 73 along the bottom 73*b* between the sides 73*c* and 73*d*. The strip 73*g* is secured on the inner surface 73*e* with stitching, adhesive, fabric welding, or like fastening method which provides a strong, durable, flexible, and permanent fastening to the inner surface 73*e*. The engagement elements 35 are aligned and spaced apart along the strip 73*g* and are each directed outwardly away from the inner surface 73*e*.

The panels 20 and 21, and the flaps 70, 71, 72, and 73, are each constructed from a material or combination of materials having durable, pliable, flexible, resilient, and inelastic material characteristics on which ink, silkscreening, or other markings may be applied, such as cloth, nylon fabric, or the like.

The covering 10 is useful for covering the gate 11 with a decorative aesthetic so as to conceal the gate 11 and blend in with the home decor. With reference to FIG. 1, the covering 10 is shown as it would appear installed on the gate 11. The gate 11 illustrated there is a releasable gate that may be temporarily placed in the passageway 15 and then moved to another passageway without harming the walls or requiring fasteners or anchors to secure the gate 11 in the passageway 15. The top and bottom frame members 12 and 13 terminate in rubber bumpers that are compressed against the walls 15*a* and 15*b* of the passageway to prevent the walls 15*a* and 15*b* from being damaged. The gate 11 is typical of conventional safety gates, and one having ordinary skill in the art will readily appreciate that the covering 10 can be used on other types of safety gates. At least two methods are useful for applying the covering 10 to the gate 11. In one method, the covering 10 is applied while the gate 11 is installed in the passageway 15. In another method, the covering 10 is applied while the gate 11 is free of the passageway 15. The former method will be discussed first.

Figure 3B:
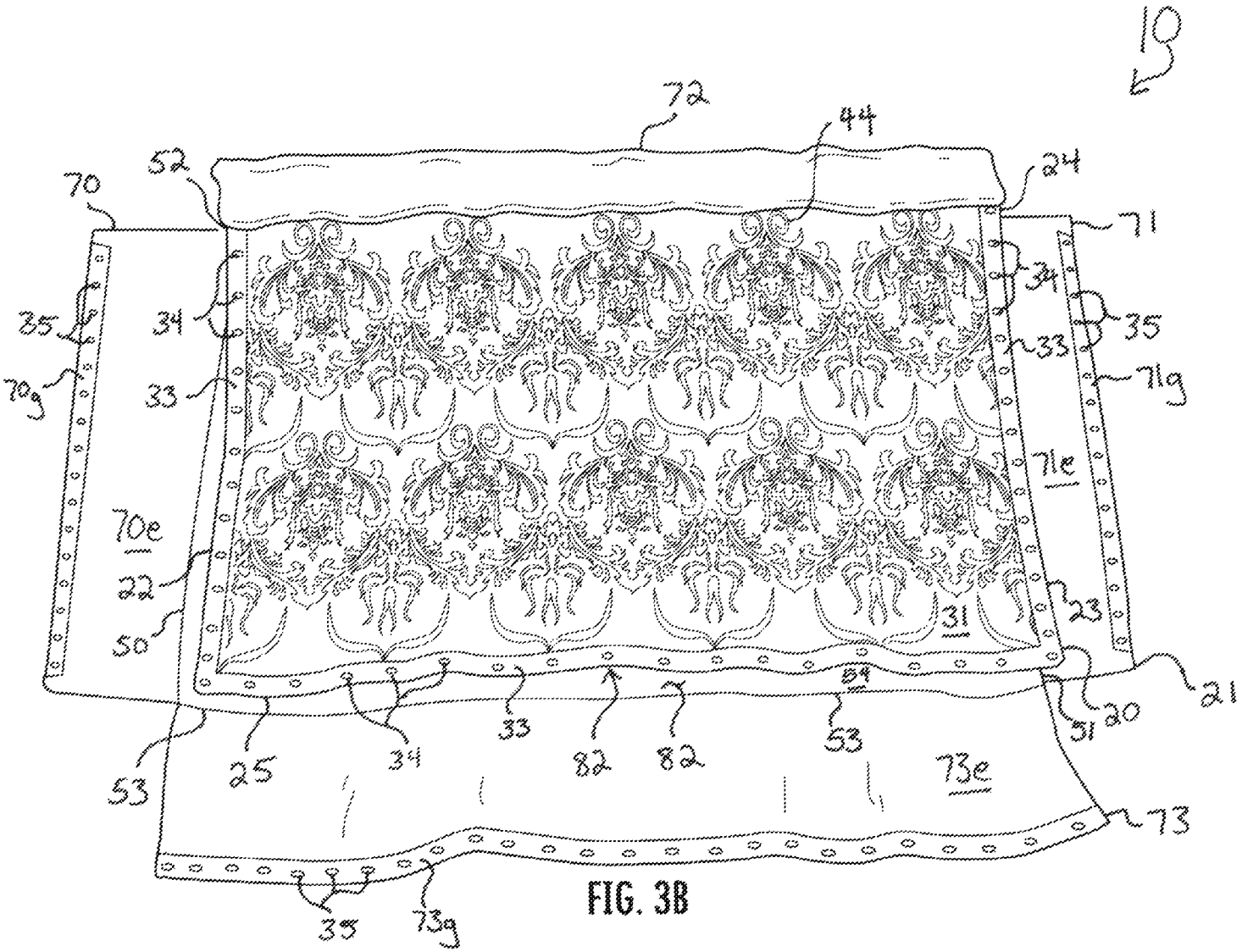

The first method is useful when the gate 11 is already installed in the passageway 15, as may be the case with a gate 11 which is anchored to the walls 15*a* and 15*b*. Though described herein as walls 15*a* and 15*b* for convenience, one having reasonable skill in the art will understand that the gate 11 may be applied between any two stable, vertical surfaces, such as walls, banisters, door jambs, and the like. Discussion of this method will be made with reference to FIGS. 1, 3A, 3B, and FIG. 3C. The panels 20 and 21 are placed on the ground, with the panel 20 on top of the panel 21, as shown in FIG. 3A. The upper edges 24 and 52 are aligned, the lower edges 25 and 53 are aligned, and the inner surfaces 30 and 54 are in contact against each other, as shown in FIG. 3B. With the upper edges 24 and 52 aligned, the upper flap 72 of the panel 21 is taken up, such as by hand, and folded over the upper edge 24 of the panel 20. The engagement elements 34 of the engagement assembly 36 on the strip 33 along the perimeter edge 32 on the outer surface 31 of the panel 20 are snappedly engaged with the engagement elements 35 carried on the strip 72*g* on the inner surface 72*e* of the flap 72, thus coupling the upper edges 24 and 52 of the panels 20 and 21, respectively, to each other with the upper flap 72. In this condition, the panels 20 and 21 are arranged as a sleeve with an open end 82 at the bottom leading to a gate-receiving area 83 formed between the panels 20 and 21. The open end 82 is formed along the bottoms 25 and 53, is coextensive with the bottoms 25 and 53, and defines an opening into the gate-receiving area 83. The gate-receiving area 83 has a thin profile sized and shaped to receive the gate 11, and is bound by the inner surfaces 30 and 54 of the panels 20 and 21, respectively, which are gate-receiving surfaces.

Figure 3C:
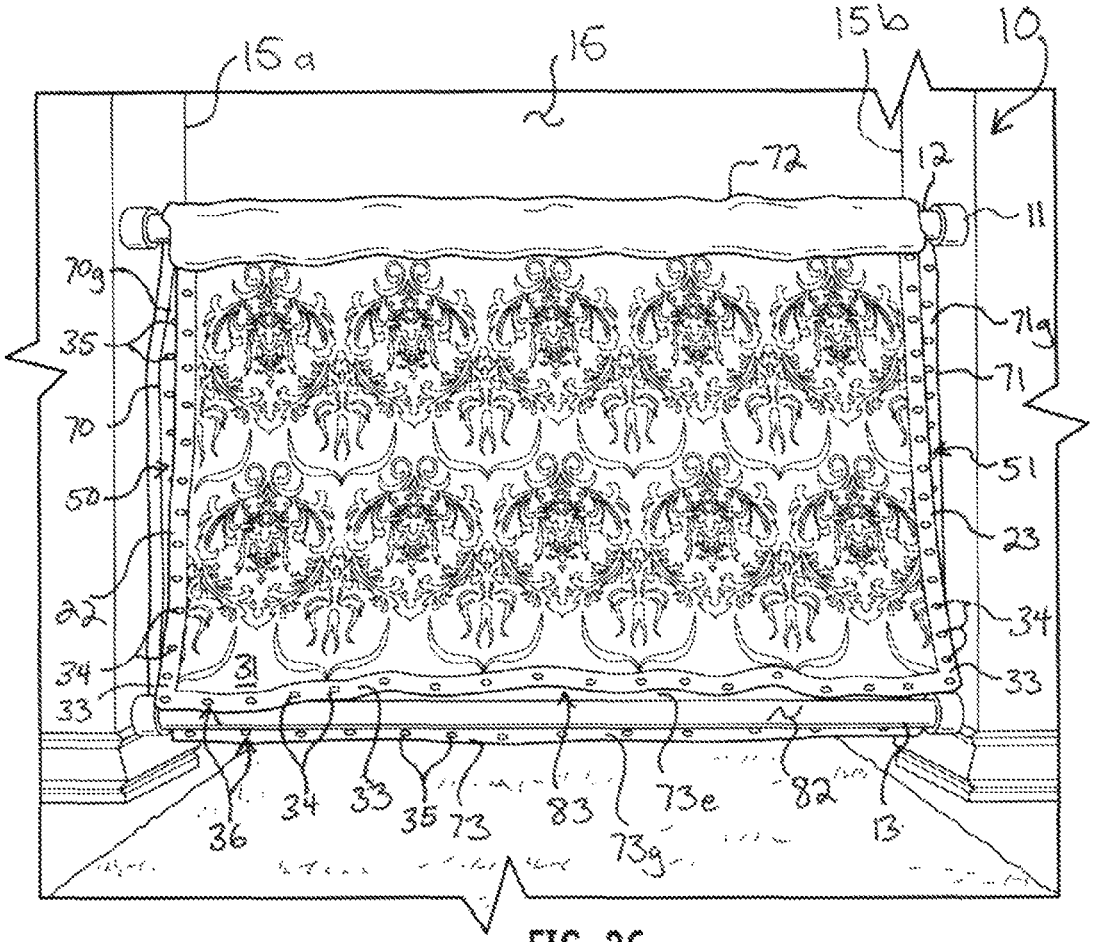

Arranged as a sleeve, the covering 10 is ready to be applied over the gate 11 to arrange the covering 10 as illustrated in FIG. 3C. The covering 10 is held over the gate 11 with the open end 82 directed downward toward the gate 11, the side edge 22 proximate to the wall 15*a*, and the side edge 23 proximate to the wall 15*b*. The covering 10 is lowered over the gate 11, applying the gate 11 into the gate-receiving area 83 with the panels 20 and 21 parting to the front 16 and back 17 of the gate 11, respectively. The covering 10 is lowered over the gate 11 until the flap 72 is laid along the top frame member 12 of the gate 11. The side edges 22 and 23 of the panel 20 are proximate to the walls 15*a* and 15*b*, respectively, and the side flaps 70 and 71 of the panel 21 are proximate to the walls 15*a* and 15*b*, respectively.

The side flap 70 on the panel 21 is then secured to the side edge 22 of the panel 20, the side flap 71 on the panel 21 is secured to the side edge 23 of the panel 20, and the lower flap 73 is secured to the lower edge 25 of the panel 20. To secure the side flap 70, the side flap 70 is taken up, as by hand, and folded around the outermost vertical frame member 14 proximate to the side edge 22 of the panel 20 (concealed in FIG. 3C, but shown in FIG. 1), and then over the side edge 22. The engagement elements 34 of the engagement assembly 36 on the strip 33 on the outer surface 31 along the side edge 22 are snappedly engaged with the engagement elements 35 carried on the strip 70*g* on the inner surface 70*e* of the flap 70, coupling the side edges 22 and 50 of the panels 20 and 21, respectively. Arranged in this way, the side flap 70 is held between the wall 15*a* and the vertical frame member 14 proximate to the side edge 22, concealing gaps between the gate 11 and the wall 15*a*, and the side edges 22 and 50 are securely and closely retained against the gate 11. FIG. 1 illustrates the side flap 70 engaged in this fashion.

Next, to secure the side flap 71, the side flap 71 is taken up, such as by hand, folded around the outermost vertical frame member 14 proximate to the side edge 23 (concealed by the panel 50 in FIG. 3C but shown in FIG. 1), then folded over the side edge 23 of the panel 20. The engagement elements 34 of the engagement assembly 36 on the strip 33 on the outer surface 31 along the side edge 23 are snappedly engaged with the engagement elements 35 carried on the strip 71*g* on the inner surface 71*e* of the side flap 71, coupling the side edges 23 and 51 of the panels 20 and 21, respectively. Arranged in this way, the flap 71 is held between the wall 15*b* and the vertical frame member 14 proximate to the side edge 23, concealing gaps between the gate 11 and the wall 15*b*, and the side edges 23 and 51 are securely and closely retained against the gate 11. FIG. 1 illustrates the side flap 71 engaged in this fashion, in which the panels 20 and 21 and the flaps 70, 71, 72, and 73 define a sleeve for the gate 11.

Finally, arranged in this way, the lower flap 73 defines an entrance or opening into the covering 10 as a sleeve, in communication with the gate-receiving area 83, which moves between a closed position and an open position away from the panel 20 and which is sized to receive the gate 11 therethrough. To secure the lower flap 73 in the closed position thereof, the lower flap 73 is taken up, such as by hand, and folded around the bottom frame member 13 and over the lower edge 25 of the panel 20. The engagement elements 34 of the engagement assembly 36 on the strip 33 on the outer surface 31 along the lower edge 25 are snappedly engaged with the engagement elements 35 carried on the strip 73*g* on the inner surface 73*e* of the lower flap 73, coupling the lower edges 25 and 53 of the panels 20 and 21, respectively, together with the lower flap 73. Arranged in this way, the lower flap 73 is held between the floor and the bottom frame member 13, concealing gaps between the gate 11 and the floor, and the lower edges 25 and 53 are securely and closely retained against the gate 11. In this way, the covering 10 is arranged in an installed condition on the gate 11 as illustrated in FIG. 1. Installing the covering 10 in the manner described above is helpful in circumstances in which the gate 11 is permanently fastened in the passageway 15 or the homeowner desires to not have to remove the gate 11 to install the covering 10.

Figure 4A:
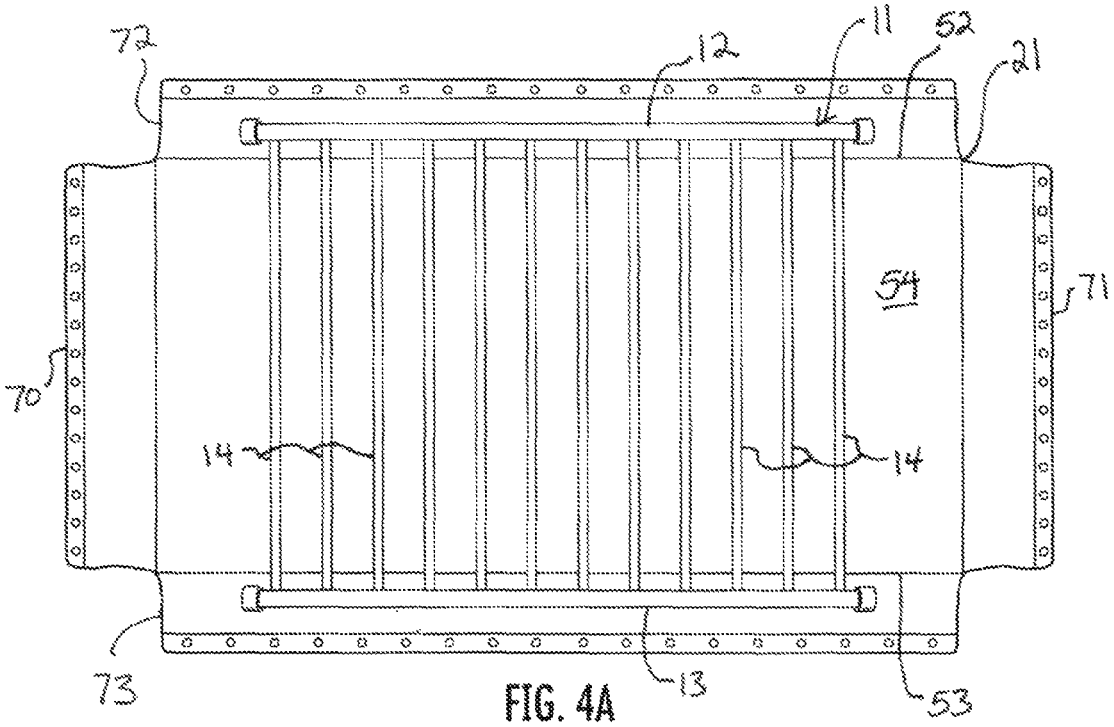
FIGS. 4A-4C are perspective views illustrating a sequence of steps of an alternate manner of arranging and applying the decorative gate covering of FIG. 1 on the passageway gate.
Figure 4B:
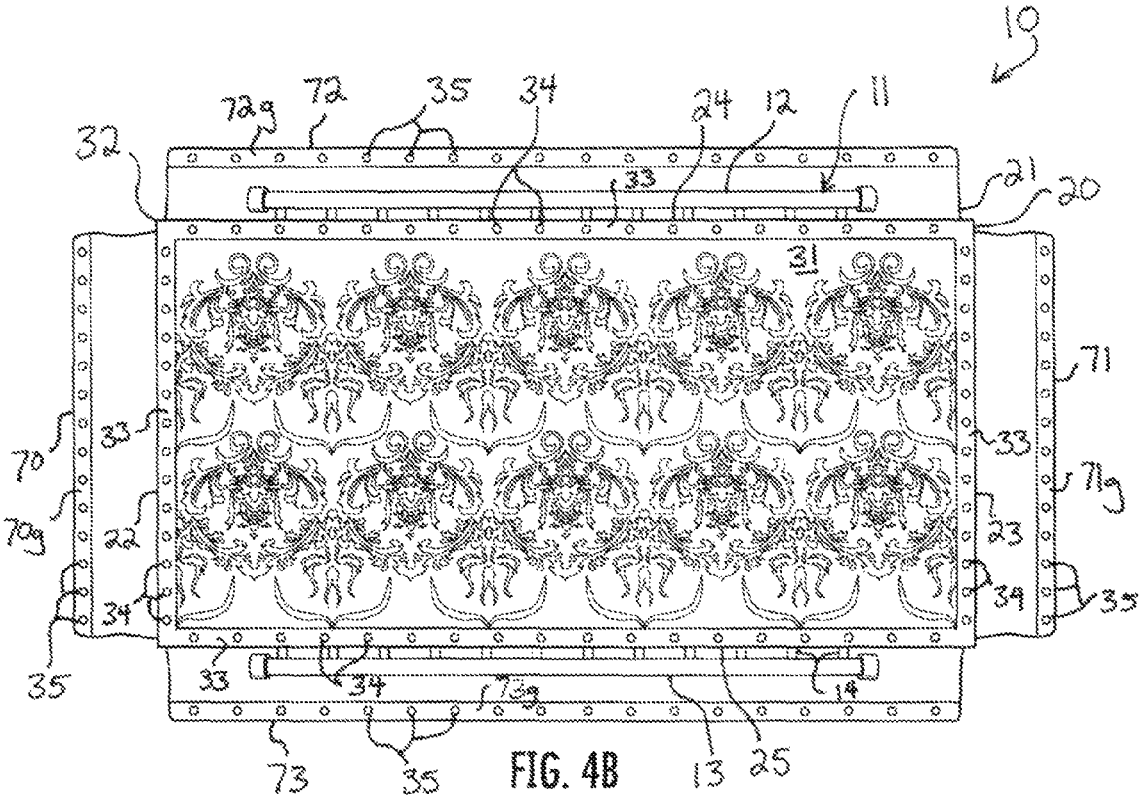
Figure 4C:
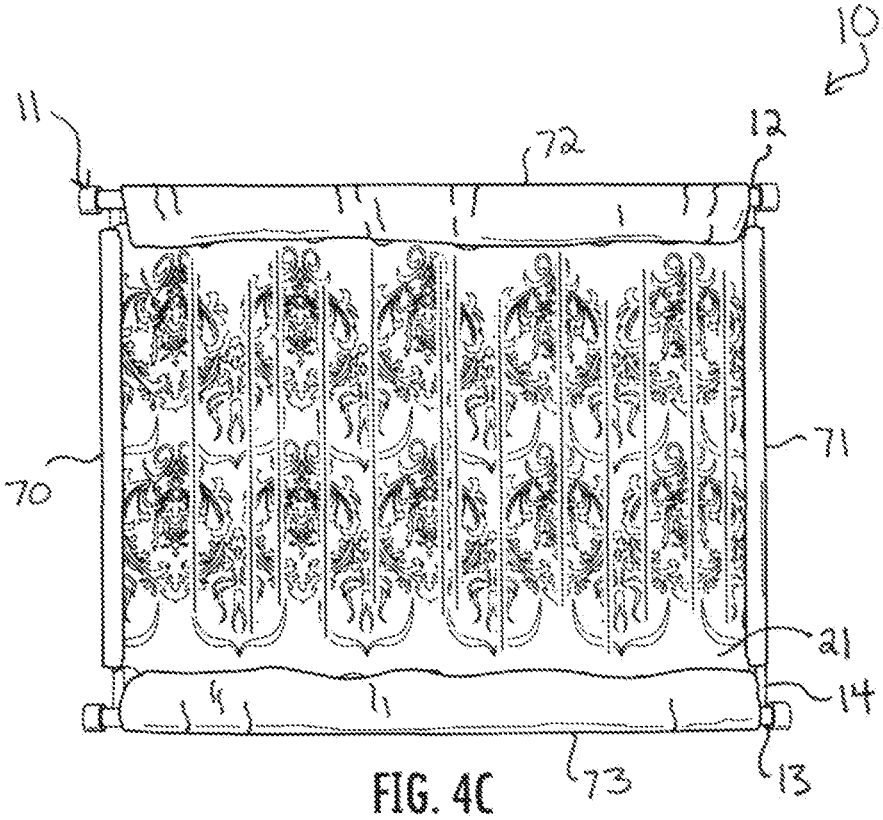

If the gate 11 has not yet been applied to the passageway 15, another method of installing the covering 10 may be used. With reference now to FIGS. 4A-4C, this other method of installing will be explained. The following discussion also describes a manner of applying the covering 10 to a gate 11 which is smaller than the covering 10. The panel 21 is first placed on the floor with the outer surface 55 directed toward the floor and the inner surface 55 directed upwards. The gate 11 is laid atop the inner surface 54 of the panel 21 as shown in FIG. 6A, with the top frame member 12 aligned with the upper edge 52 of the panel 21, just outboard of the upper edge 52 and the bottom frame member 13 aligned with the lower edge 53 of the panel 21, just outboard of the lower edge 53. The ends of the top and bottom frame members 12 and 13 are shorter than the upper and lower flaps 72 and 73, so that the bumpers do not project beyond the panel 21.

The panel 20 is then placed over the gate 11 as illustrated in FIG. 4B, with the inner surface 30 directed toward the gate 11, the outer surface 31 directed away from the gate 11, the upper edge 24 of the panel 20 aligned with the top frame member 12, and the lower edge 25 of the panel 20 aligned with the bottom frame member 13. The engagement elements 35 on each of the flaps 70, 71, 72, and 73 are then secured to the complemental engagement elements 34 carried on the side edge 22, side edge 23, upper edge 24, and lower edge 25, respectively, as described above with reference to the former method of installation, so as to secure the flaps 70, 71, 72, and 73 along the perimeter edge 32 of the panel 20 and bound and conceal the gate 11 in the gate-receiving area 83 between the panels 20 and 21, as shown in FIG. 2. The inner faces 30 and 54 of the panels 20 and 21 are gate-receiving surfaces which are directed against the front 16 and back 17 of the gate 11.

With gates 11 such as those illustrated in FIGS. 4A-4C that are smaller than the covering 10, the covering 10 can be adjusted to fit the gate 11. FIG. 4C shows the covering 10 adjustably fit onto the gate 11, with the upper and lower flaps 72 and 73 and the panel 20 bunched in an accordion fashion. The panel 21 is also bunched in an accordion fashion but is hidden in this view. Bunching in this way allows the width of the covering 10 to be reduced so as to fit onto a smaller gate 11. The covering 10 is suitable for installation on different types of gates 11 having different widths. The durable, pliable, and flexible material characteristics of the flaps 70, 71, 72, and 73 allow the flaps 70, 71, 72, and 73 to be gathered and bunched when the covering 10 is installed on a narrow gate 11 in a passageway 15, and allow the flaps 70, 71, 72, and 73 to be stretched when the covering 10 is installed on a wide gate 11 in a wide passageway 15. Similarly, the durable, pliable, and flexible material characteristics of the panels 20 and 21 allow the panels 20 and 21 to be bunched or stretched as needed to fit the gate 11 installed in a narrow or wide passageway 15.

Once the covering 10 is installed on the gate 11, the gate 11 may then be installed in the passageway 15 as shown in FIG. 1 in a well-known and conventional fashion, by positioning the gate 11 in the passageway 15 and then securing the gate 11 in the passageway 15. With the covering 10 arranged in an installed condition, the gate 11 is substantially concealed from observation, except for end portions of the top and bottom frame members 12 and 13 which protrude out from the gate-receiving area 83 through holes at open corners 90, 91, 92, and 93 formed along the perimeter edges 32 and 60 of the covering 10. The open corners 90, 91, 92, and 93 are formed between the flaps 70, 71, 72, and 73; specifically, open corner 90 is formed between the side flap 70 and the upper flap 72, open corner 91 is formed between the side flap 71 and the upper flap 72, open corner 92 is formed between the side flap 70 and the lower flap 73, and open corner 93 is formed between the side flap 71 and the lower flap 73. Each of the open corners 90, 91, 92, and 93 are outboard from the panels 20 and 21 and are in spatial communication with the gate-receiving area 83 and are sized and shaped to receive the ends portions of the top and bottom frame members 12 and 13 therethrough. The top and bottom frame members 12 and 13 are closely encircled by the open corners 90, 91, 92, and 93. Other than those end portions of the top and bottom frame members 12 and 13 barely visible in open corners 90, 91, 92, and 93, the remainder of the gate 11 is concealed by the covering 10.

The covering 10 can be easily removed from the safety gate by reversing the steps described in either of the above two methods of installation. One easy method of removal is to separate the engagement assemblies 35 along the side flaps 70 and 71 and the lower flap 73 and to lift the covering 10 off of the gate 11.

Figure 5A:
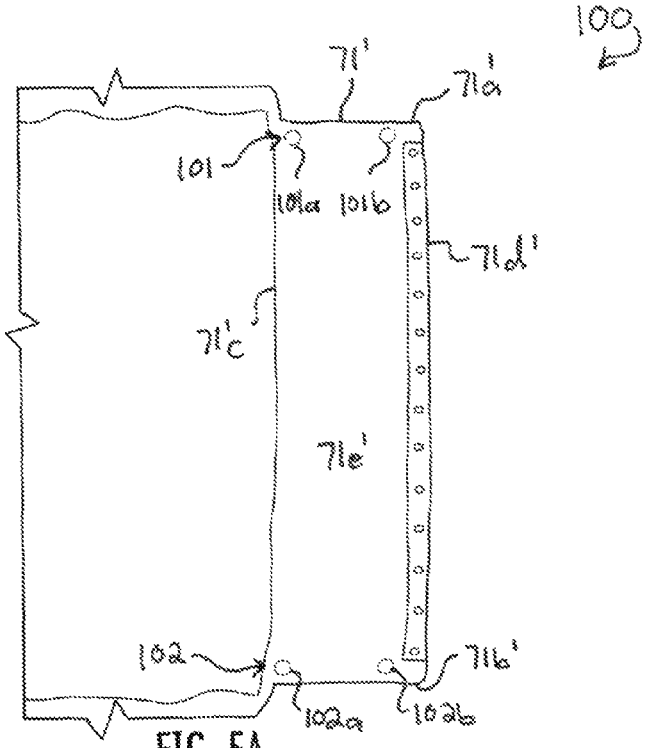
FIG. 5A is an enlarged front view of a panel of an alternate embodiment of a decorative gate covering having snap closure engagement assemblies formed thereon.
Figure 5B:
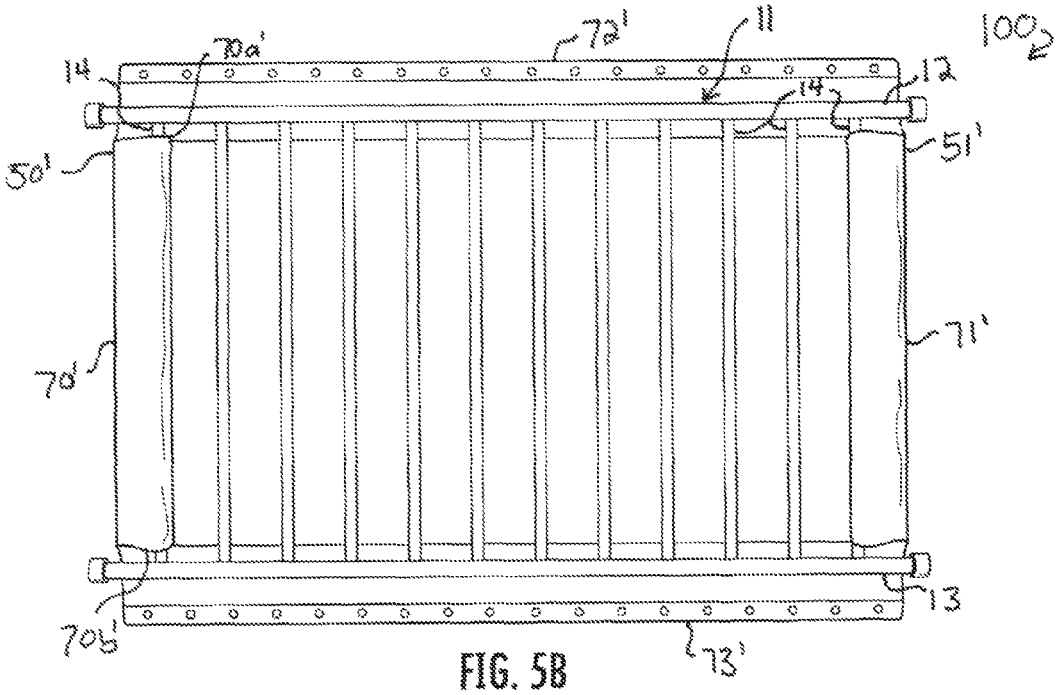
FIG. 5B is a front view of the panel of FIG. 5A applied to a passageway gate.

An alternate embodiment of decorative gate covering is shown in FIGS. 5A and 5B and is identified with the reference character 100. The covering 100 is identical in nearly every respect to the covering 10 but contains. As such, the reference characters used to identify the various structural elements and features of the covering 10 are also used to identify identical structural elements and features of the covering 100, but are designated with a prime ("") symbol so as to distinguish them from those of the covering 10. Those additional structural elements and features allow the covering 100 to be more securely attached to the gate 11. The side flaps 70' and 71' carry snap closure engagement assemblies for securing the panel 21' and covering 100 on the gate 11. The snap closure engagement assemblies are identical to each other and only two of the snap closure engagement assemblies will be described herein, with the understanding that the discussion applies equally to the other snap closure engagement assemblies. Snap closure assemblies 101 and 102 are shown on the side flap 71' in FIG. 5A. The snap closure assembly 101 includes a male snap closure engagement element 101*a* for snappedly fitting to and being secured in a female snap closure assembly 101*b*. The male snap closure engagement element 101*a* is disposed along the inner side 71*c*' of the side flap 71' proximate to the top 71*a*' of the side flap 71', and the complemental female snap closure engagement element 101*b* is disposed along the outer side 712' of the side flap 71' proximate to the top 71*a*' of the side flap 71'. The male and female snap closure engagement elements 101*a* and 101*b* are each mounted to the inner surface 71*e*' of the side flap 71' with stitching, fabric welding, or like fastening method which provides a strong, durable, flexible, and permanent fastening to the inner surface 71*e*'. One having reasonable skill in the art will appreciate that the snap closures 101*a* and 101*b* may be different fasteners such as hook-and-loop fasteners.

The snap closure engagement assembly 102 includes a male snap closure engagement element 102*a* and a female snap closure engagement element 102*b* which are identical to the male and female snap closure engagement elements 101*a* and 102*b*. The male snap closure engagement element 102*a* is disposed along the inner side 71*c*' proximate the bottom 71*b*' of the side flap 71', and the female snap closure engagement element 102*b* is disposed along the outer side 71*d*' of the side flap 71' proximate to the bottom 71*b*'.

The covering 100 is applied to the gate 11 similarly to the covering 10, and as such, only the differences in application will be explained in detail. The covering 100 is applied to the gate 11, and to secure the covering 100 to the gate 11, the side flaps 70' and 71' are secured about two of the outermost vertical frame members 14. The vertical frame member 14 proximate to the side edge 51' is placed within the side flap 71' and the side flap 71' is wrapped around the vertical frame member 14' proximate to the side edge 51', so that the elements of the snap closure engagement assemblies 101 and 102 carried at the top 71*a*' and bottom 71*b*' on the inner surface 71*e*' of the side flap 71' are proximate to each other and can be engaged so as to close the snap closure engagement assemblies 101 and 102. The snap closure engagement assemblies 101 and 102 are both closed so that the flap 71' encircles and is applied to the vertical frame member 14 proximate to the side edge 51', limiting movement of the flap 71' off the vertical frame member 14 proximate to the side edge 51' so as to secure the covering 100 on the gate 11. Similarly, the snap closure engagement assemblies carried on the side flap 70' are engaged, securing the flap 70' on the vertical member 14 proximate to the side edge 50', as seen in FIG. 5B. The method of installation described above with respect to the covering 10 is then continued to apply and install the covering 100 to the gate 11.

In multi-portion safety gates that include hinged doors to allow the safety gate to be installed and still provide ingress and egress to adults, multiple coverings 10 can be used. Such multi-portion safety gates typically have a left fixed gate portion, a right fixed gate portion, and a middle door portion hinged to either the left or right fixed gate portions. To cover such a multi-portion gate with a decorative aesthetic, three coverings 10 are used. A first covering 10 is applied to the left fixed gate portion, a second covering 10 is applied to the right fixed gate portion, and a third covering 10 is applied to the middle door portion, each covering 10 being applied according to one of the methods described above. One having ordinary skill in the art will readily appreciate that each of the first, second, and third coverings 10 are identical to the coverings 10 described above and share identical structures and features, but may be smaller in width to better accommodate the smaller left, right, and middle portions of the multi-portion safety gate. Further, one having ordinary skill in the art will readily appreciate that the covering 10 is useful with other multi-portion safety gates, such as two-portion safety gates, four-portion safety gate, and the like.

Figure 6:
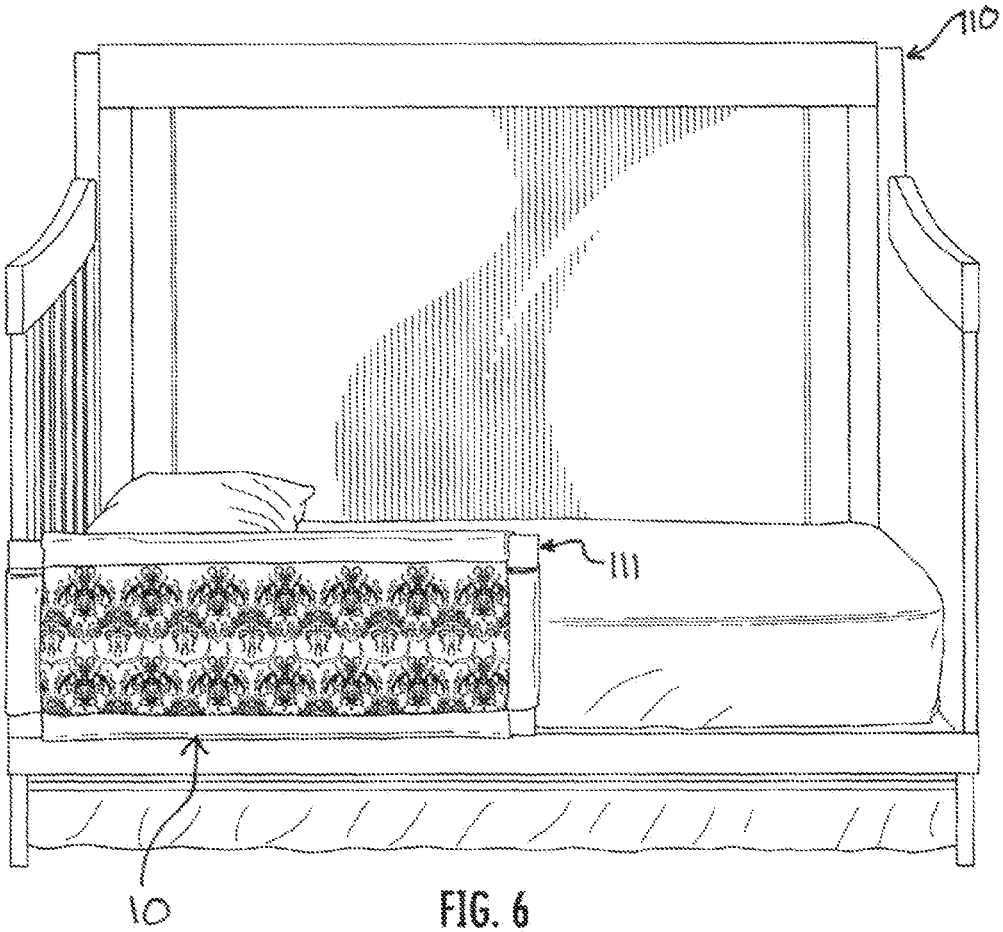
FIG. 6 is a front perspective view of the decorative gate covering of FIG. 1 applied to a toddler's bed.

In yet another embodiment, the covering 10 can also be used on cribs and toddler beds. FIG. 6 illustrates that covering 10 applied to a toddler bed 110. The toddler bed 110 has a safety guard 111 with vertical and horizontal frame members, and the covering 10 is applied to the safety guard 111 to conceal the safety guard 111 and blend in with the decoration on the toddler bed 110 or in the child's room. It is noted that the covering 10 in FIG. 6 is smaller than that covering 10 show in previous FIGS.

The present invention is described above with reference to a preferred embodiment. However, those skilled in the art will recognize that changes and modifications may be made in the described embodiment without departing from the nature and scope of the present invention. To the extent that such modifications and variations do not depart from the spirit of the invention, they are intended to be included within the scope thereof.

Having fully and clearly described the invention so as to enable one having skill in the art to understand and practice the same, the invention claimed is:

The invention claimed is:

1. A decorative covering for covering a passageway gate, the covering comprising:

a sleeve bounding a gate-receiving area, the sleeve including a front, a back, and a perimeter between the front and back;

the gate-receiving area is sized and shaped to receive and cover the passageway gate between the front, back, and perimeter of the sleeve;

the front of the sleeve is a planar front panel having opposed upper and lower edges, opposed first and second side edges, an inner face defining a gate-receiving surface between the upper and lower edges extending from the first side edge to the second side edge, and an opposed outer face carrying a decoration;

the back of the sleeve is a planar rear panel having opposed upper and lower edges, opposed first and second side edges, an inner face defining a gate-receiving surface between the upper and lower edges extending from the first side edge to the second side edge, and an opposed outer face carrying a decoration;

separate upper, lower, and first and second side flaps extend outwardly away from the rear panel and are detachably coupled to the front panel;

the perimeter includes a bottom which is releasably coupled to the front of the sleeve to move between a closed position secured to the front of the sleeve and an open position away from the front of the sleeve, defining an entrance to the gate-receiving area sized to receive the passageway gate for application therethrough; and openings are formed in the perimeter in communication with the gate-receiving area and are configured to closely encircle frame members of the passageway gate applied through the openings.

2. The covering of claim 1, wherein:

the perimeter includes four corners; and one of the openings is formed at each of the corners.

3. The covering of claim 1, wherein:

the upper and lower flaps extend completely across the upper and lower edges, respectively, between the opposed sides edges of the rear panel; and the first and second side flaps extend completely across the first and second side edges, respectively, between the upper and lower edges.

4. The covering of claim 1, wherein the upper and lower flaps, and the first and second side flaps, are pliable.

5. The covering of claim 1, wherein:

each of the upper, lower, and first and second side flaps overlies the outer face of the front panel; and engagement elements carried on each of the upper, lower, and first and second side flaps are detachably engaged with complemental engagement elements carried on the front panel.

6. The covering of claim 5, wherein the openings are defined in the perimeter between the upper, lower, and first and second side flaps.

7. A decorative covering for covering a passageway gate, the covering comprising:

a front panel for covering the passageway gate and having an upper edge, a lower edge, opposed first and second side edges, an inner face, and an outer face carrying a decoration;

a rear panel for covering the passageway gate and having an upper edge, a lower edge, opposed first and second side edges, an inner face, and an outer face carrying a decoration;

the rear panel includes upper, lower, and first and second side flaps extending from the upper edge, lower edge, and first and second side edges of the rear panel, respectively;

the upper, lower, and first and second side flaps are releasably coupled along the upper edge, lower edge, and first and second side edges of the front panel, respectively, with fasteners;

first and second upper openings are formed outboard of the front and rear panels between the upper flap and the first and second side flaps, respectively; and first and second lower openings are formed outboard of the front and rear panels between the lower flap and the first and second side slaps, respectively;

wherein the front and rear panels cooperate to define a gate-receiving area spaced therebetween in communication with each of the first and second upper and lower openings.

8. The covering of claim 7, wherein:

the upper and lower flaps extend completely across the upper and lower edges, respectively, between the opposed sides edges of the rear panel; and the first and second side flaps extend completely across the first and second side edges, respectively, between the upper and lower edges.

9. The covering of claim 7, wherein the upper and lower flaps, and the first and second side flaps, are pliable.

10. The covering of claim 7, wherein:

each of the upper, lower, and first and second side flaps overlies the outer face of the front panel; and engagement elements carried on each of the upper, lower, and first and second side flaps are detachably engaged with complemental engagement elements carried on the front panel.

11. The covering of claim 7, wherein:

the front panel is larger than the passageway gate;

the rear panel is larger than the passageway gate; and the upper and lower flaps adjust in accordion fashion to fit the passageway gate.

12. The covering of claim 11, wherein the front and rear panels adjust in accordion fashion to cover the passageway gate.

13. A decorative covering for covering a passageway gate, the cover comprising:

a front panel having opposed upper and lower edges, opposed first and second side edges, an inner face defining a gate-receiving surface between the upper and lower edges extending from the first side edge to the second side edge, and an opposed outer face carrying a decoration;

a rear panel having opposed upper and lower edges, opposed first and second side edges, an inner face defining a gate-receiving surface between the upper and lower edges extending from the first side edge to the second side edge, and an opposed outer face carrying a decoration;

the rear panel is formed with opposed, spaced-apart upper and lower flaps extending outwardly away from the rear panel along the upper and lower edges, respectively;

the rear panel is formed with opposed, spaced-apart first and second side flaps extending outwardly away from the rear panel along the first and second side edges, respectively;

engagement assemblies carried between the front panel and each of the upper, lower, and first and second side flaps;

the engagement assemblies detachably engage each of the upper, lower, and first and second side flaps to the front panel;

first and second upper corner openings are defined between the upper flap and the first and second side flaps, respectively; and first and second lower corner openings are defined between the lower flap and the first and second side flaps, respectively.

14. The cover of claim 13, wherein the engagement assemblies are carried along the upper and lower edges and the first and second side edges of the front panel.

15. The cover of claim 13, wherein:

the first and second side flaps each extend between the upper and lower edges of the rear panel; and the upper and lower flaps each extend between the first and second side flaps.

16. The cover of claim 13, wherein the gate-receiving surfaces of the inner faces of the front and rear panels cooperate to define a thin, rectangular gate-receiving area therebetween for receiving and covering the passageway gate applied to the gate-receiving area.

17. The covering of claim 13, wherein the upper and lower flaps, and the first and second side flaps, are pliable.

18. The covering of claim 13, wherein:

the front panel is larger than the passageway gate;

the rear panel is larger than the passageway gate; and the upper and lower flaps adjust in accordion fashion to fit the passageway gate.

19. The covering of claim 18, wherein the front and rear panels adjust in accordion fashion to cover the passageway gate.

* * * * *